United States Patent [19]

Bain, Jr. et al.

[11] Patent Number: 4,901,081

[45] Date of Patent: Feb. 13, 1990

[54] ELLIPTICAL INFLATABLE RADAR REFLECTOR

[75] Inventors: John H. Bain, Jr., Dickinson; Gene E. Gentry, Alvin, both of Tex.

[73] Assignee: Lifeball International Corporation, Houston, Tex.

[21] Appl. No.: 234,741

[22] Filed: Aug. 22, 1988

[51] Int. Cl.[4] ..... H01Q 15/20; H01Q 15/18

[52] U.S. Cl. ..... 342/8; 342/10

[58] Field of Search ..... 342/7, 8, 10; 343/915

[56] References Cited

U.S. PATENT DOCUMENTS

| | | | |
|---|---|---|---|
| 2,898,588 | 8/1959 | Graham | 342/10 |
| 3,221,333 | 11/1965 | Brown | 343/915 |
| 4,117,486 | 9/1978 | Sharp | 342/12 |
| 4,673,934 | 6/1987 | Gentry et al. | 342/8 |

FOREIGN PATENT DOCUMENTS

| | | | |
|---|---|---|---|
| 0681666 | 10/1952 | United Kingdom | 342/8 |
| 0812376 | 4/1959 | United Kingdom | 342/8 |

*Primary Examiner*—Thomas H. Tarcza
*Assistant Examiner*—Gilberto Barrón, Jr.
*Attorney, Agent, or Firm*—Bill B. Berryhill

[57] ABSTRACT

Improved radar reflector apparatus which includes a collapsible and inflatable radar wave permeable envelope which when inflated assumes the shape of an ellipsoid. The ellipsoid envelope surround a radar reflective array having a number of radar wave reflectors which, when the envelope is inflated, are arranged to form a plurality of corner reflectors. The reflectors are in the shape of right multilaterals having two sides perpendicular to one another and the other sides forming obtuse angles where the apexes of these angles may provide points of attachment to the inner surface of the inflatable envelope.

13 Claims, 2 Drawing Sheets

$$S=\left[\frac{4\pi}{(.03)^2}\right]\left\{\frac{\pi}{2}\left(\frac{3}{4\pi}\right)^{2/3}\left(1-E^2\right)^{1/6}\sin\left[\left(\tan^{-1}\right)\left(\frac{1}{\sqrt{2}\sqrt{1-E}}\right)\right]\right\}^2$$

ELLIPTICAL INFLATABLE RADAR REFLECTOR

BACKGROUND OF THE INVENTION

1. Field of the Invention

The present invention is directed to an improved inflatable radar reflector. Specifically, it is directed to improved geometry for the shape of the inflatable envelope, the shape of the internal reflectors, and the means of suspension by which the reflectors are deployed to accurate planar alignment.

2. Description of the Prior Art

The effectiveness of radar detection is related to the effectiveness with which a radar source signal may be reflected from an object, i.e. a radar reflector. Radar reflectors may be utilized for air/sea rescue, vessel avoidance, marking of temporary runways, designation of hazardous areas, etc. In such an application, the larger the radar cross-section of the reflector, the better. The successful incorporation of an effective corner reflector array into an inflatable device has been found to provide a radar cross-section which is many times larger than an object the same size without a corner reflector array.

Corner reflector arrays have been designed which are included in an inflatable assembly having flexible or collapsable internal corner reflectors that may be folded into extremely small volumes, such as into the pocket of a life vest, so as to be easily stored. The corner reflector array may reside in a flexible material which is resilient and not easily damaged. The corner reflector array residing inside an inflatable flexible envelope insures that the reflector may not be bent out of shape or otherwise functionally impaired, even during severe use. The inflatable reflector may be inflated orally or with compressed air or with lighter than air gas.

Previous patents of the prior art have addressed the design of inflatable corner reflector systems. Such examples may be seen in U.S. Pat. Nos. 2,463,517; 3,103,662 and 3,115,631. However, due to the method of construction of inflatable radar reflectors of the prior art, the corner reflector arrays thereof are distorted substantially reducing their effectiveness as radar reflectors, particularly for modern day radar systems utilizing shorter wave lengths.

U.S. Pat. No. 4,673,934 discloses a much improved inflatable radar reflector in which the corner reflector array thereof is constructed and attached in such a manner that the reflectors are held taut and flat and in proper orthogonal orientation significantly reducing puckers, sags, twists or angular misalignment inherent in prior art designs. This results in an inflatable radar reflector of significantly greater radar cross section enhancement.

In many inflatable radar reflector applications, a compressed gas supply is required for automatic inflation. The weight and volume required for the inflation system may be larger than the weight and volume of the stowed radar reflector. For this reason, the volume of an inflatable radar reflector is a limiting design consideration. The effectiveness of an inflatable radar reflector is thus significantly enhanced if the volume required for a given radar cross section can be minimized.

In essentially all of the prior art inflatable radar reflectors, a plurality of triangular reflectors are arranged in a tetrahedral array forming eight corner reflectors which are suspended in a spherical inflatable envelope. It has also been found that the spherical-triangular-tetrahedral geometry limits the radar cross section which may be obtained per unit of volume.

SUMMARY OF THE INVENTION

The present invention is directed to an improvement in the shape of the inflatable envelope of a radar reflector and an improvement in the shape of the reflective surfaces which are suspended therewithin as well as improvement in the means of suspension. The present invention provides improvement over the prior art in reduction of the volume required to obtain the same unit cross section as the spherical prior art and also provides improvement in the reduction of sags, puckers, and wrinkles in the suspended reflector surfaces.

The present invention utilizes an inflatable envelope which when inflated assumes the shape of an ellipsoid. The elliptical shaped inflatable has a larger surface area per unit volume than a spherical shaped inflatable. The radar cross section of the internal radar reflector is dependent upon the surface area of the suspended reflectors. The surface area available in the internal reflectors increases in a manner similar to the surface area of the inflatable. The surface area of the suspended reflectors is greater for an ellipsoid than for a sphere of the same volume. For this reason, the ellipsoid shaped inflatable of the present invention results in a greater radar cross section than an inflatable radar reflector in the shape of a sphere of the same volume.

The radar cross section is further enhanced in the present invention by utilizing reflector surface elements with non-triangular shape. The area of the reflectors is increased by using right quadrilaterals, right pentalaterals, or in general, right multilateral shaped reflectors. Larger radar cross section results from the increased area of the reflector surfaces. An inflatable radar reflector having right multilateral reflectors will have a significantly larger radar cross section than an inflatable radar reflector of the same volume having triangular shaped reflectors. In addition to being larger in area, the multilateral reflectors also benefit from better stress equalization when erected. Since the reflector is attached to the inflatable inner surface at more than two points, the stress which is tranferred from the inflatable to the reflector is distributed more evenly. This equalization of tension in the reflector results in a more perfectly planar suspension of the surface, having fewer sags, puckers, twists, or other imperfections.

The present invention utilizes reflectors which are each independently suspended within the inflatable envelope by a string or tension means which circumnavigates the reflector through folded seams along the edges of each reflector in the array. A string or tension means passes alternately through an edge seam of the reflector and then through an attaching clip means, through another edge seam, through another attaching clip means, etc. until all of the reflectors are circumnavigated. The attaching clip means may be fastened to eyelets or otherwise attached on the inner surface of the inflatable envelope. Upon inflation, the reflectors are held taut and flat and will float to the position of proper orthogonal orientation. This suspension system is significantly enhanced by the introduction of multiple rings which are spaced along the common adjacent edges of the reflector surfaces where notches have been cut in the edge seams. These rings provide stress equalization by distributing the stress in the reflector fabric. This reduces the sags, puckers, twists, and other imperfections of planar erection, resulting in a more perfectly flat, taut, reflective surface.

The principal feature and advantage of the present invention is that the radar cross section which may be obtained per unit volume is significantly enhanced.

Another feature and advantage of the present invention is that the reflective surfaces of the corner reflector are held more taut and flat and with a significant reduction in puckers, sags, or planar imperfections as a result of improved distribution of stress in the reflector material due to the improved shape of the reflectors and the introduction of multiple rings at the adjacent seams.

Another feature and advantage of the present invention is the provision of a greater radar cross section enhancement than with a reflector of the same size and configuration but having the puckers, sags, twists, and planar imperfections of prior art designs.

Another feature and advantage of the present invention is the provision of greater radar cross section enhancement for radar systems operating at higher frequencies, i.e. shorter wavelengths, than with similar reflectors whose puckers, sags, and planar imperfections exceed one sixth of the wavelength of the radar signal.

Still another feature and advantage of the present invention is an elliptical inflatable envelope which may be constructed using fewer seams than a spherical inflatable and therefore less costly to manufacture and more reliable, having less likelihood of leaks to develop at the seams.

Many other objects and advantages of the invention will be apparent from reading the description which follows in conjunction with the accompanying drawings.

DESCRIPTION OF PREFERRED EMBODIMENT

Figure 1:
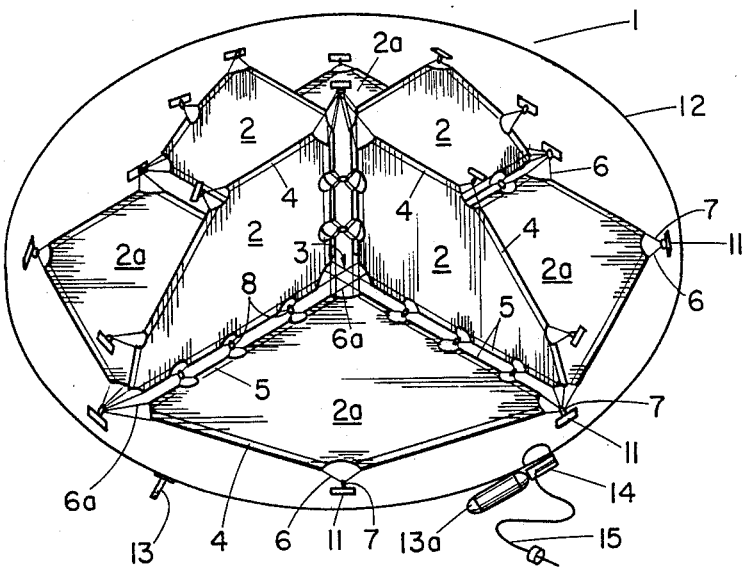
FIG. 1 is an isometric view of an inflatable radar reflector according to a preferred embodiment of the invention.

FIG. 1 of the drawings illustrates a preferred embodiment of the invention. A corner reflector array 1 is formed by eight right pentalateral reflectors 2 and four right quadrilateral reflectors 2*a* having reflective surfaces on each side thereof and which are made of flexible, radar wave reflective material such as metal impregnated cloth, metalized film material, laminated foil, impregnated rubber, or the like. When in proper position, the reflector members 2, 2*a* form a plurality of three-sided corner reflectors, the apexes of which substantially coincide at the center 3 of said array 1. In the embodiment of FIG. 1, each of the reflectors 2 defines a right pentalateral with two sides perpendicular to each other and the other three sides substantially conforming to the contour of the ellipse. Each of the reflectors 2*a* defines a right quadrilateral with two sides perpendicular to each other and the other two sides substantially conforming to the major diameter contour of the ellipse. The reflector array 1 comprises eight three-sided (trihedral) corner reflectors the sides of which are substantially at right angles to each other.

Figure 2:
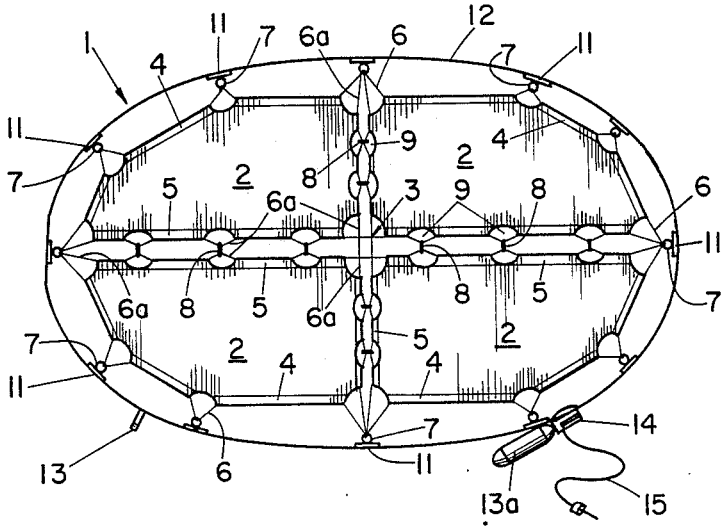
FIG. 2 is a side view showing detail of the suspension system in which four reflector elements are suspended to form one of the three orthogonal planes of the corner reflector array.

FIG. 2 is a side view showing detail of the reflectors 2 and the suspension system wherein like numbers denote like parts. The reflectors 2 and 2*a* are made with a seam along each outer edge 4 and a seam along each inner edge 5. These edge seams provide a path and enclosure through which a tension producing string 6, 6*a* may pass. The string 6, 6*a* also passes through attaching clips 7 which are located at each of the outer apexes of the reflectors. The string passes through ring means 8 located at notches 9 in the inner edge seams 5 at intervals along the adjacent inner edges of the reflectors 2, 2*a*. Each one of these ring means 8 has four segments 6*a* of the string passing through it; one from each of the four reflectors 2, 2*a* which lie perpendicular to each other and whose edges are adjacent thus providing parallel paths for the four strings in the adjacent edges. A variety of alternative methods for the path of the string 6, 6*a* are possible using one or more strings. The preferred method is to use six strings; three perimeter strings 6, one around the perimeter of the outer edges of the four reflectors 2, 2*a* in each of the three orthogonal planes; and three axis strings 6*a*, one through the adjacent edges of each of the three orthogonal axes. A perimeter string 6, starting at one of the attaching clips 7 passes through a folded outer edge seam 4; then through another attaching clip 7; then another outer edge seam 4; another clip 7 etc. until all of the outer edge seams 4 for all four of the reflectors 2, 2*a* in one of the three orthogonal planes are circumnavigated. An axis string 6*a*, starting at one of the attaching clips 7 located at the end point of one of the three orthogonal axes passes through the inner edge seam 5; exiting from the edge seam at one of the notches 9 in the seam; then passing through a ring means 8; then re-entering the edge seam 5 through the notch means 9; passing through the next segment of edge seam 5; exiting at the next notch means 9; through the next ring means 8; re-entering the notch means etc. until the attaching clip 7 at the opposite end of the orthogonal axis is reached. At this point, the string passes through the attaching clip 7; turning one hundred-eighty degrees to complete a similar path through the inner edge seams 5 of two other reflectors 2, 2*a* and passing through the same ring means 8 once more. After four such passes, all of the edge seams 5 in one axis are complete.

Figure 4:
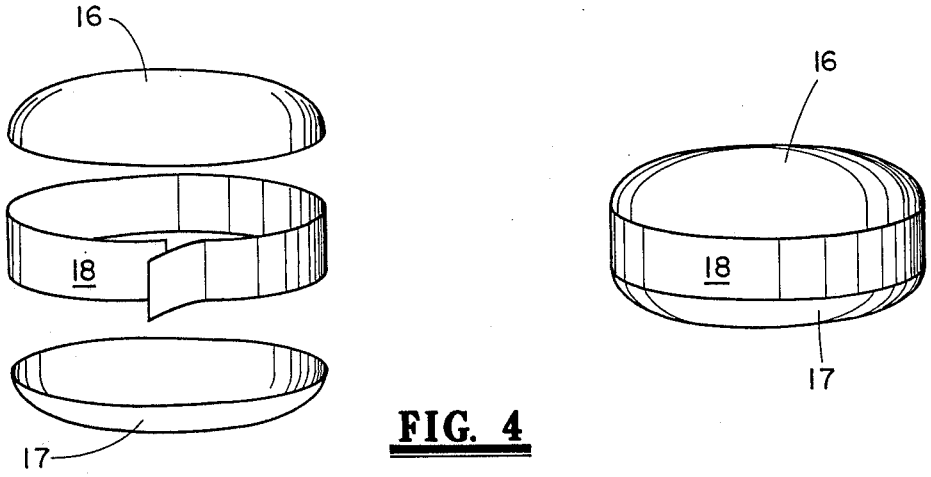
FIG. 4 is an exploded view of the inflatable envelope showing how the elliptical inflatable outer shell is formed in a preferred embodiment of the invention.

The attaching clips 7 are attached to eyelet means (not shown) or to tab means 11 located near the inner surface of the inflatable envelope 12. The inflatable envelope 12 may be constructed of flexible, water and air impermeable but radar wave permeable material such as polyvinylchloride film, polyurethane film, or other plastic film material, rubber sealed cloth material or the like. The preferred inflatable envelope is constructed as an ellipsoid which is formed of three pieces as shown in FIG. 4. FIG. 4 shows that the inflatable envelope consists of a circular top piece 16 and circular bottom piece 17 which are seamed to a rectangular piece 18 forming a cylinder. In the general case this inflatable will, when inflated, assume the shape of a cylinder having elliptical caps at the top and bottom. As the width of the rectangular piece 18 is decreased the elliptical end caps are moved closer together. If the width of the reactangular piece 18 is equal to 0.2133 times the diameter of the circular top 16 and bottom 17 pieces, then, when inflated, the inflatable will assume the shape of a true ellipsoid having an eccentricity of 0.866.

Figure 3:
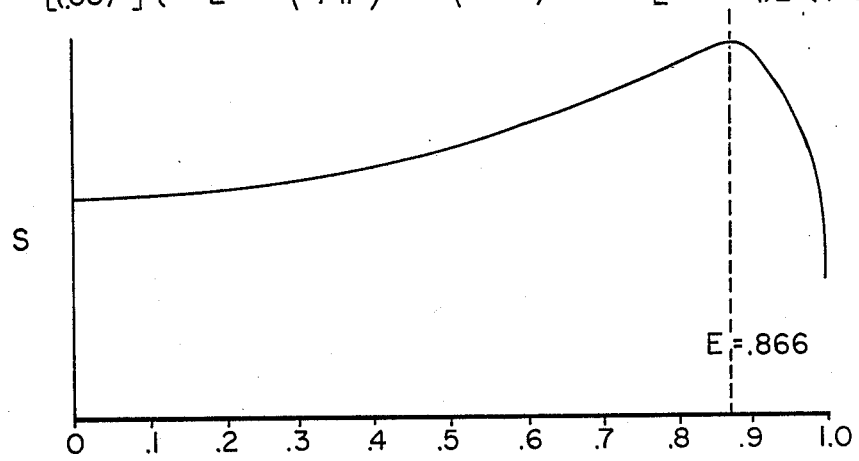
FIG. 3 is a graph of the mathematical function describing the relationship between the theoretical maximum radar cross section of the elliptical inflatable radar reflector and the eccentricity of the ellipsoid.

FIG. 3 is a graph of the mathematical function for the maximum radar cross section (in square meters) at an assumed wavelength of 3 centimeters (10 Gigahertz) for an ellipsoidally shaped radar reflector having an eccentricity of E. The radar cross section S is the dependent variable and the eccentricity E is the independent variable. The volume of the inflatable is normalized to one cubic meter. A spherically shaped inflatable can be considered as a special case of an ellipsoid having an eccentricity value of E=0. The formula is:

$$S = \left[\frac{4\pi}{(.03)^2}\right]\left\{\frac{\pi}{2}\left(\frac{3}{4\pi}\right)^{2/3}(1-E^2)^{1/6}\,\mathrm{SIN}\left[(\mathrm{TAN}^{-1})\left(\frac{1}{\sqrt{2}\,\sqrt{1-E}}\right)\right]\right\}^2$$

The graph shows that the maximum value of radar cross section corresponds to an eccentricity value of 0.866. The inflatable envelope shape of the preferred embodiment of the invention is an ellipsoid with an eccentricity value of precisely 0.866 which achieves optimization of the radar cross-section per unit volume.

Figure 5:
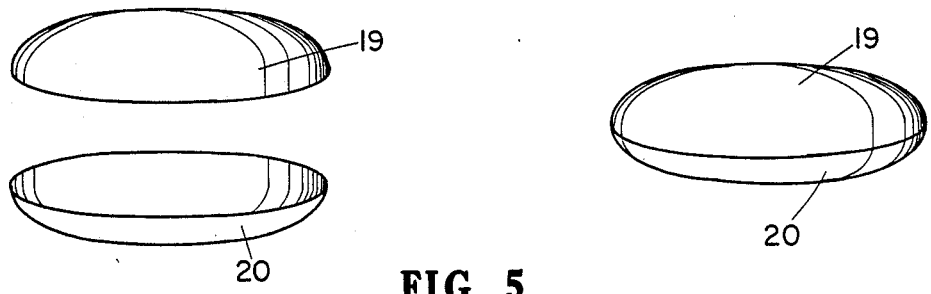
FIG. 5 is an exploded view of the inflatable envelope showing how the elliptical inflatable outer shell is formed in another preferred embodiment of the invention.

FIG. 5 shows another preferred embodiment of the inflatable envelope. In this embodiment the inflatable is formed by only two pieces: a circular top 19 which is seamed to a similar circular bottom piece 20. When inflated, this inflatable will assume the form of an ellipsoid with an eccentricity value of 0.707. This is slightly less optimum than the three piece inflatable previously described but is capable of achieving ninety-four percent of the maximum radar cross section and benefits from added manufacturing simplicity.

As the inflatable envelope 12 is inflated, the strings 6, **6*a* are drawn tight. Since each reflector 2, 2*a* is surrounded by the tight string the reflective surfaces of the reflectors are held taut and flat without puckers, sags, or twists. The strings 6, 6*a* are able to slip through the outer folded seams 4, the inner folded seam 5, the ring means 8, and the attaching clips 7 so as to become aligned orthogonally. The ring means 8 which are spaced along the adjacent inner seams 4 serve to hold the reflectors 2 in close proximity to each other and each exerting a force which is conducive to a more perfectly flat planar deployment of the reflector surface. The distribution of this force at multiple points along each axis serves to more evenly distribute the stress in the reflector material thus further reducing the sags, puckers, and other imperfections of the planar deployment. The accuracy of the angular alignment of the reflectors 2 is a function only of the accuracy of placement of the eyelets (not shown) or the tabs 11 in the inflatable envelope 12 and is not dependent upon the accuracy of construction of the reflectors 2**.

An oral inflation valve 13 or compressed gas cartridge **13*a* provides for introduction of gas into the inflatable 12. The type and number of inflation valve(s) used will vary depending on whether inflation is to be accomplished orally, with compressed gas, or with a lighter than air gas. Fixtures 14 may be attached to the exterior of the inflatable envelope 12 and provide attachment for a lanyard 15. The lanyard 15** may be provided for attaching the inflatable radar reflector system to a person or object. Similar fixtures may be attached to serve as handles or as application specific affixing devices.

Having described the invention in the preferred embodiments, it should be understood that inflatable radar reflectors having variations in the shape of the inflatable envelope and shape of the reflectors are possible utilizing the same functional component parts and employing the same principle of erecting a flexible array. For example, the preferred embodiment utilizes eight right pentalateral and four right quadrilateral shaped reflectors; however, for larger inflatable radar reflectors the number of sides may be increased and the number of ring means located in the adjacent seams of the orthogonal axis may likewise be increased. The reflectors may all have the same number of sides or mixed, as in the preferred embodiment, with reflectors of differing number of sides. Other configurations of inflatable envelope construction are also possible which result in ellipsoids which when inflated have values of eccentricity in the optimum range. In fact, many variations of the invention are possible without departing from the spirit of the invention. Accordingly, it is intended that the scope of the invention be limited only by the claims which follow.

We claim:

1. Improved radar reflector apparatus comprising a collapsible and inflatable radar wave permeable envelope which when inflated assumes the shape of an ellipsoid surrounding a radar reflective array having a number of radar wave reflectors which when said envelope is inflated are arranged to form a plurality of corner reflectors, said reflectors being of a flexible material so as to allow collapsing of said reflector array upon collapse of said envelope, and suspension means supporting each of said reflectors within said envelope independently of each other of said reflectors so that upon inflation of said envelope each of said reflectors floats on said suspension means to seek out optimum planar disposition to form planes substantially independent of and mutually orthogonal to planes formed by other of said reflectors, one or more of said reflectors being in the shape of right multilaterals having two sides perpendicular to one another and the other sides forming obtuse angles where the apexes of said angles may provide additional points of attachment to the inner surfaces of said inflatable envelope.

2. Improved radar reflector apparatus as set forth in claim 1 in which one or more of said reflectors are in the shape of right quadrilaterals having two sides perpendicular to one another and the other two sides forming an obtuse angle where the apex of said obtuse angle may provide one of said additional points of attachment to the inner surface of said inflatable envelope.

3. Improved radar reflector apparatus as set forth in claim 1 in which one or more of said reflectors are in the shape of right pentalaterals having two sides perpendicular to one another and the other three sides forming two obtuse angles where the apexes of said two obtuse angles may provide two of said additional points of attachment to the inner surface of said inflatable envelope.

4. Improved radar reflector apparatus as set forth in claim 1 in which each of said reflectors is in the shape of a right multilateral having two inner sides perpendicular to each other and a plurality of outer sides forming obtuse angles the apexes of which are disposed adjacent the inner surface of said envelope and a longitudinal seam being provided along each side thereof, said suspension means comprising string means passing through said seams and being connected to the inner surface of said envelope, the portions of said string means passing through the seams of the inner sides of said reflectors crossing at perpendicular relationships substantially at the center of said envelope.

5. Improved radar reflector apparatus as set forth in claim 4 in which the portion of said string means passing through the seams of said outer sides of said reflectors is connected to attachment means affixed to the inner surface of said envelope.

6. Improved radar reflector apparatus as set forth in claim 5 in which there are twelve reflectors forming eight trihedral corner reflectors, said reflectors being arranged in three sets of four to also form three mutually orthogonal planes.

7. Improved radar reflector apparatus as set forth in claim 6 in which said string means comprises six strings including three perimeter strings, one through the seams around the perimeter of the outer sides of each of said set of four reflectors forming said three mutually orthogonal planes and including three axis strings, one through the seams of adjacent reflector sides along each of three orthogonal axes.

8. Improved radar reflector apparatus comprising a collapsible and inflatable radar wave permeable envelope which when inflated assumes the shape of an ellipsoid surrounding a radar reflective array having a number of radar wave reflectors which when said envelope is inflated are arranged to form a plurality of corner reflectors, said reflectors being of a flexible material so as to allow collapsing of said reflector array upon collapse of said envelope, and suspension means supporting each of said reflectors within said envelope independently of each other of said reflectors so that upon inflation of said envelope each of said reflectors floats on said suspension means to seek out optimum planar disposition to form planes substantially independent of and mutually orthogonal to planes formed by other of said reflectors, the edges of each of said reflectors being provided with a longitudinal seam, said reflector array being suspended within said envelope by string means passing from the inner surface of said envelope through the seams of some of said reflectors to a center location of the apparatus and back through other of the seams of said reflectors to said inner surface of said envelope wherein the seams of said reflectors where the seams are suspended parallel to one another are provided with notch means in said seams, ring means being disposed at said notch means so that the strings from each of said parallel seams may pass out of the notch means of said seam through said ring means and back into the seam wherein all of the strings traversing the parallel seams may pass through the same ring means and be drawn together at each said ring means.

9. Improved radar reflector apparatus comprising a collapsible and inflatable radar wave permeable envelope which when inflated assumes the shape of an ellipsoid surrounding a radar reflective array having a number of radar wave reflectors which when said envelope is inflated are arranged to form a plurality of corner reflectors, said reflectors being of a flexible material so as to allow collapsing of said reflector array upon collapse of said envelope, and suspension means supporting each of said reflectors within said envelope independently of each other of said reflectors so that upon inflation of said envelope each of said reflectors floats on said suspension means to seek out optimum planar disposition to form planes substantially independent of and mutually orthogonal to planes formed by other of said reflectors, said envelope and said surrounded radar reflective array are constructed so that when inflated, said envelope and said surrounded radar reflective array will assume the shape of an ellipsoid having an eccentricity value of between 0.70 and 0.95.

10. Improved radar reflector apparatus as set forth in claim 9 in which said envelope is comprised of three pieces wherein a top and bottom piece are each seamed to a rectangular piece which is seamed at the ends to form a cylinder so that upon inflation said inflatable envelope will assume the form of a cylinder with ellipsoidal end caps.

11. Improved radar reflector apparatus as set forth in claim 9 in which said envelope is comprised of three pieces wherein a top and bottom piece are each seamed to a rectangular piece which is seamed at the ends to form a cylinder the width of which is less than or equal to approximately two tenths of the diameter of said circular pieces so that upon inflation said inflatable envelope will assume the form of an ellipsoid.

12. Improved radar reflector apparatus as set forth in claim 9 in which the inflatable envelope is comprised of two pieces seamed together so that upon inflation said inflatable envelope will assume the shape of an ellipsoid.

13. Improved radar reflector apparatus as set forth in claim 9 in which the eccentricity of said ellipsoid is a value substantially near 0.866.

* * * * *